United States Patent [19]

Sorenson

[11] Patent Number: 5,072,212

[45] Date of Patent: Dec. 10, 1991

[54] ENTRY ALARM

[76] Inventor: Gary R. Sorenson, 15781 Hayes Trail, Apple Valley, Minn. 55124

[21] Appl. No.: 628,636

[22] Filed: Dec. 17, 1990

[51] Int. Cl.[5] ..... G08B 13/08; H01H 3/16

[52] U.S. Cl. ..... 340/546; 200/61.76; 200/274; 340/548; 340/693; 361/170

[58] Field of Search ..... 340/546, 825.31-825.32, 340/548, 693, 691; 361/170; 200/61.93, 61.72, 61.74, 61.76, 273-274

[56] References Cited

U.S. PATENT DOCUMENTS

| | | | |
|---|---|---|---|
| 3,261,010 | 7/1966 | Kardel | 340/546 |
| 3,270,333 | 8/1966 | La Barber | 340/546 |
| 3,378,830 | 4/1968 | Patrick | 340/546 |
| 3,720,937 | 3/1973 | Lang et al. | 340/543 |
| 3,745,551 | 7/1973 | Smith | 340/546 |
| 3,878,539 | 4/1975 | Gooding | 340/546 |
| 3,887,909 | 6/1975 | Beiswenger et al. | 340/548 X |
| 4,059,832 | 11/1977 | Conklin | 340/546 |
| 4,258,359 | 3/1981 | McLamb | 340/546 |
| 4,275,391 | 6/1981 | Okamura | 340/571 |
| 4,340,884 | 7/1982 | Maizland | 340/548 |
| 4,438,428 | 3/1984 | Ober et al. | 340/521 |
| 4,484,181 | 11/1984 | Schwartz | 340/521 |
| 4,586,028 | 4/1986 | McKinzie | 340/546 X |
| 4,808,974 | 2/1989 | Cantley | 340/546 |

*Primary Examiner*—Glen R. Swann, III
*Assistant Examiner*—Thomas J. Mullen, Jr.
*Attorney, Agent, or Firm*—Donald A. Jacobson

[57] ABSTRACT

A self contained alarm is arranged to be attached to a door or near a building opening. One version uses a spring loaded switch held open by a door frame, which closes and sounds an audible alarm when the door is opened. A relay with normally open contacts is energized with the alarm to maintain the alarm until a reset switch is opened by a card or key inserted into a mating slot. Another version uses a rotary trip switch which is operated by a line. The line is placed across a building opening to be guarded and closes the rotary switch if the line is disturbed. A second embodiment uses an arm-disarm switch also operated by a card or key inserted into a mating slot to control a second relay. This arm-disarm switch is placed in a second box on the outside of a door to be guarded to permit arming the alarm after the door is closed. Here contacts of the second relay keep the alarm circuit open until the card or key is withdrawn to provide an arm-disarm function.

17 Claims, 9 Drawing Sheets

ENTRY ALARM

FIELD OF THE INVENTION

This invention relates to the field of door mounted portable alarm systems arranged to provide an audible alarm whenever a specific predetermined mechanical disturbance of the alarm is made.

BACKGROUND OF THE INVENTION

There are a number of portable alarms in the prior art. In Schwartz, U.S. Pat. No. 4,484,181; an audible alarm will sound whenever the door holding the alarm is opened, which allows a spring loaded switch to close. In Ober et al. U.S. Pat. No. 4,438,428; an alarm attached to the top edge of a door has a spring loaded switch held open by the door frame when the door is closed. When the door is opened the switch can close to sound the alarm. In Okamura, U.S. Pat. No. 4,275,391; a pendulum is incorporated into the alarm such that when the alarm is moved the pendulum will close a switch to sound an alarm. In Conklin, U.S. Pat. No. 4,059,832; a portable alarm has a buzzer and batteries in series with a spring loaded plunger operated switch. The alarm is held by a special bracket over a door such that the switch plunger is held in which is the off position. When the door is opened the plunger is released and the switch closes to sound the alarm. In Gooding, U.S. Pat. No. 3,878,539; a switch comprising a coiled spring body portion extending from the housing is capable of electrically contacting a conductive member within the housing. A cap member is secured to the coiled spring arm which includes an actuating tip which extends laterally beyond a mounting surface of the housing so that when the housing is mounted relative to a door surface and the door is close an actuating tip is displaced from electrical contact but when the door is open the tip will return to a normal position and close the switch to sound the alarm. In Smith, U.S. Pat. No. 3,745,551; an alarm device which clamps onto a door and is arranged such that when the door is open an alarm will sound for 60 seconds. In Lang et al., U.S. Pat. No. 3,720,937; a battery operated alarm system completely contained within an inverted U-shaped assembly is designed to fit over the top of a door and held in place with double-sided tape. A sensor sets off a battery operated alarm unless a code-operated device on the outside of the door is correctly manipulated before the door is opened. In Patrick, U.S. Pat. No. 3,378,830; an alarm is attached to the top of a door and has an arm which extends over the top of the door. When the door is closed this arm holds an alarm circuit open when the door is opened the arm permits the circuit to close. In La Barber, U.S. Pat. No. 3,270,333; a door mounted alarm has a cooperating support bracket which assists in closing a switch in an alarm circuit when the door is opened. In Kardel, U.S. Pat. No. 3,261,010; a portable door alarm uses an adjustable bracket to fit a variety of door widths and a pair of movable members to signal relative movement between the door and structure to sound an alarm.

SUMMARY OF THE INVENTION

This invention provides alarm apparatus which is placed adjacent to a door or window to be protected. A variety of attachment means are provided to permit attaching the alarm to a flat surface using a screw, a sticky or a magnetic tape, or near the top of a door using a bracket over the door top.

A first embodiment of the alarm circuit uses a battery, an on-off switch, and a normally open trip switch in series with a buzzer. When the on-off switch is in the on position, the trip switch is arranged to close when an entry is made through a door or window to sound the buzzer alarm.

A relay coil wired in parallel with the buzzer has a normally open set of contacts wired in series with a normally closed reset switch. This series circuit of normally open relay contacts and normally closed reset switch is connected in parallel with the trip switch and the on-off switch. Even a momentary closure of the trip switch will energize the relay coil and close the relay contacts, which will keep the alarm sounding even if the trip switch opens. Since the relay contacts and reset switch bypass both the on-off switch and the trip switch, turning either or both the on-off switch and trip switch to off will not silence the alarm.

Two types of trip switches are employed. The first is a spring loaded, single pole, normally closed switch. This switch is placed within the alarm box with the switch arm extending from the top of the alarm box. The switch arm is located such that the switch is held open by the door frame when the door holding the alarm box is closed. When the door is opened the trip switch can then close to sound the alarm. Since the alarm will sound after the on-off switch is turned on until the trip switch is held open by the door frame, this trip switch arrangement is primarily intended to be used to warn a user who remains within the room that someone has opened the door.

The second type of trip switch is a rotary switch which is rotated by a line wrapped around a portion of a cylindrical shaped rotary element. The switch has a number of evenly spaced conducting segments around the periphery each of which extend from the circumference to an axle. A switch contact is made when a wiper arm adjacent to the circumference of the rotary element contacts one of the conducting segments to connect the axle to the wiper arm, with no tension on the line, the rotary element is spring loaded to return the rotary element to an initial position where the wiper arm does not make contact with a conducting segment.

This rotary switch is positioned within the alarm box with the free end of the line extending through a hole in the side of the alarm box. The alarm box is positioned adjacent to a door or window to be guarded with the line extending across the opening and attached to the opposite side. A small amount of line is pulled from the switch as the line is attached. This may close the rotary trip switch so an adjusting means is provided to change the line extending from the switch until the switch is open. This is accomplished by trial and error. With this arrangement anyone entering through the opening and either tightening or loosening the line will rotate the rotary switch and cause the wiper to contact at least one of the segments of the rotary switch and sound the alarm.

There are two arrangements used to operate the normally closed reset switch to shut off the alarm after it has been energized by the trip switch. This reset switch is necessary because otherwise the alarm would continue to sound indefinitely because of the relay contacts. The reset switch has an extension from the switch arm so a force on the arm can open the switch. A slot on the front of the alarm can accommodate either a card or a key to open the switch. Either the key or a card must match a respective mating slot in order to be inserted fully into the slot. The switch arm is positioned within the alarm such that whether a key or a card is used they must be inserted fully into their respective matching slot in order to push against the switch arm to open the reset switch. When the trip switch is opened the relay coil is deenergized, which in turn opens the relay contacts to silence the buzzer, provided the trip switch is open; or to permit turning the alarm off using the on-off switch.

A second embodiment of the alarm uses an addition to the circuits just described to provide an arm-disarm function. This circuit is housed in a separate box similar to the alarm box which is connected to the alarm box by brackets which extend over the top of a door between the two boxes. The brackets themselves are insulated from the boxes to serve as conductors between the two boxes.

This arm-disarm function uses a switch in series with a battery and a relay coil of a second relay to control a set of normally closed relay contacts. This arm-disarm switch is normally open but when closed will open the normally closed relay contacts. These relay contacts of the second relay are connected in series with the trip switch in the alarm box and when open will prevent the buzzer from sounding.

The arm-disarm switch is closed by a inserting a key or card into a matching slot in the face of this second box the same as the alarm box. This permits using a key or card to control the arm-disarm function.

In use, the arm-disarm switch is closed by inserting the key or card before the alarm is turned on to disarm the alarm. The boxes are then positioned by placing the brackets over the top of the door. The arm-disarm switch keeps the alarm from sounding even though the trip switch will be closed until the alarm is in position and the door closed. This permits turning the alarm on using the on-off switch and positioning the boxes without sounding the alarm. After the door is closed the key or card controlling the arm-disarm function is then withdrawn after the user has exited the room to arm the system while the occupant is gone.

DETAILED DESCRIPTION OF THE EMBODIMENT

Figure 1A:
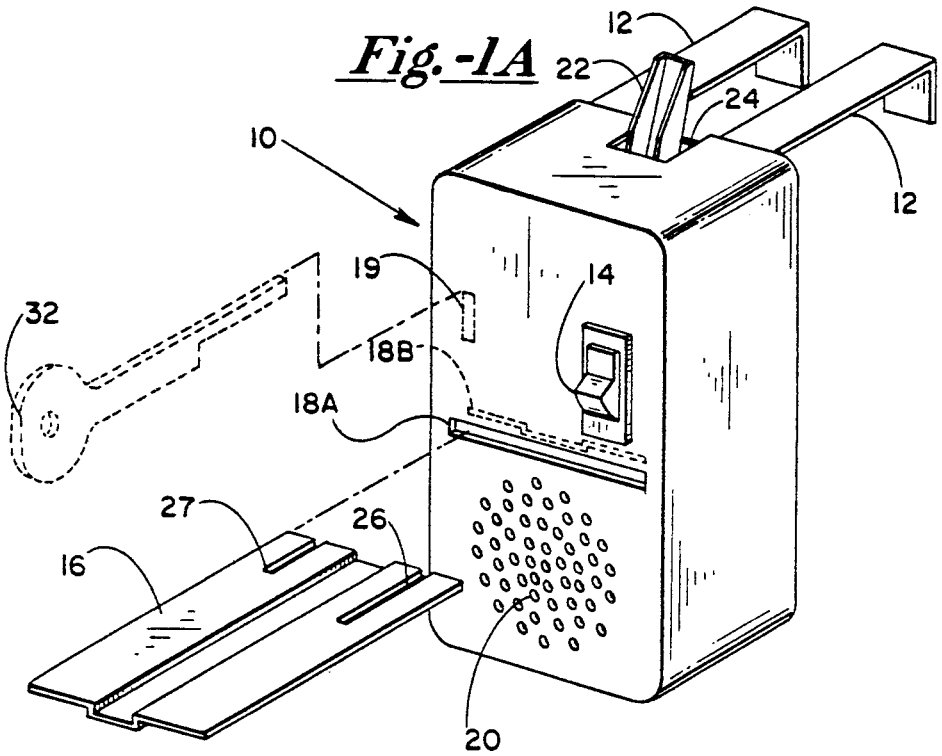
FIG. 1A is an isometric view of the first version of the first embodiment of the alarm.

In FIG. 1A alarm box 10 is shown with brackets 12 sized to secure the box to the top of a door, on-off switch 14, card 16, card slot 18A in the front face of the alarm box and a number of small holes 20 to permit sound to be transmitted through the box. Key slot 19, shown in dashed outline, provides access for a key 32 as an alternative insert to card 16.

Spring loaded trip switch 22 has an arm extending through a hole 24 in the top of box 10 which is large enough to allow the arm to move to the rear of the box to a normally closed position, or move toward the front of the box to an open position. When alarm box 10 is secured near the top of a closed door by brackets 12 the door frame will force the arm of trip switch 22 to the front of alarm box 10 to the open position.

Figure 1B:
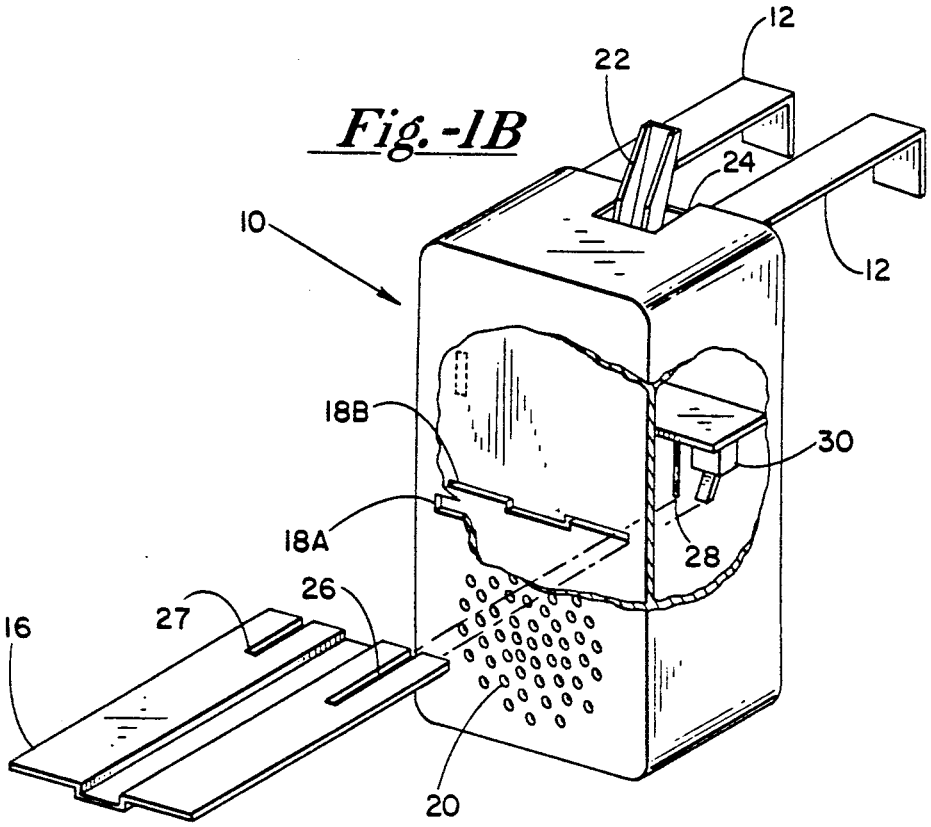
FIG. 1B is the view of FIG. 1A having a cut-out showing a portion of the interior.
Figure 1D:
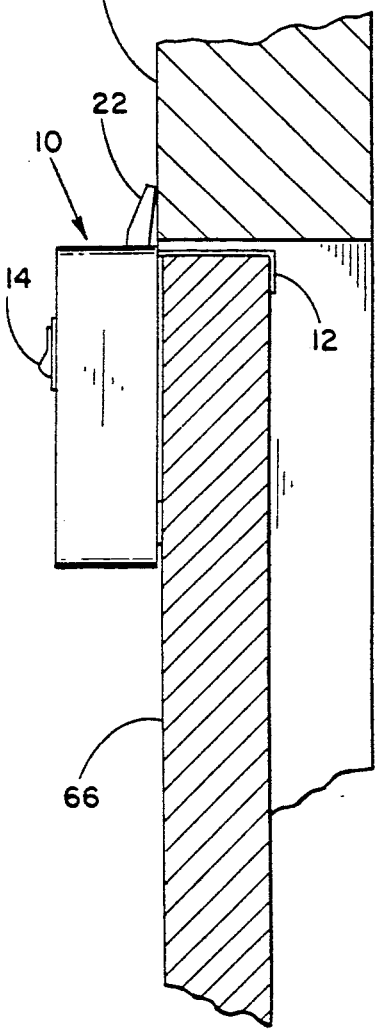
FIG. 1D is a side view of the first version of the first embodiment attached to the top of a door with the door closed into its frame, both being shown in cross-section, and showing the door frame forcing the trip switch open.

In FIG. 1D alarm 10 is shown attached to the top of a door 66 by brackets 12, with the door closed against frame 68 and switch 22 held open by the frame. In FIG. 1E door 66 is ajar from frame 68 and switch 22 is closed which will sound the alarm.

In FIG. 1B a partial view of the interior of alarm box 10 can be seen. Interior slot 18B which matches the cross-section of card 16 is mounted directly behind rectangular shaped slot 18A. If the cross-section of card 16 does not conform to slot 18B then the card cannot be inserted into the slot. Slot 18B is located within alarm box 10 behind slot 18A so that the shape of interior slot 18B cannot be observed. Card 16 has slits 26 and 27 which extend different distances into the card from the rear edge, and which are parallel to the sides of the card. Pin 28 extends across the path of slit 26 and is located such that it will be positioned at the bottom of slit 26 when card 16 is inserted full length into slot 18B. When fully inserted card 16 will push the arm of the reset switch 30 from a normally closed to an open position. Reset switch 30 is spring loaded and when card 16 is removed the spring will return the switch to the normally closed position. When card 16 is inserted into slot 18B full length a small amount will still protrude from the front of alarm box 10 to permit removing the card.

Slit 27 is not as deep as slit 26 and a second pin, not shown, is oriented the same as pin 28 in the path of this slit. The pin opposite slot 27 is closer to the rear of alarm box 10 to permit the pin to be positioned at the bottom of this shorter leftmost slit 27 as card 16 trips reset switch 30. This arrangement of slits of different depths and pins with corresponding positions, means that unless card 16 has slits at the proper location and depth the card cannot be inserted full length into slot 18B to trip reset switch 30 even if a card of the proper cross-section is used.

Figure 1C:
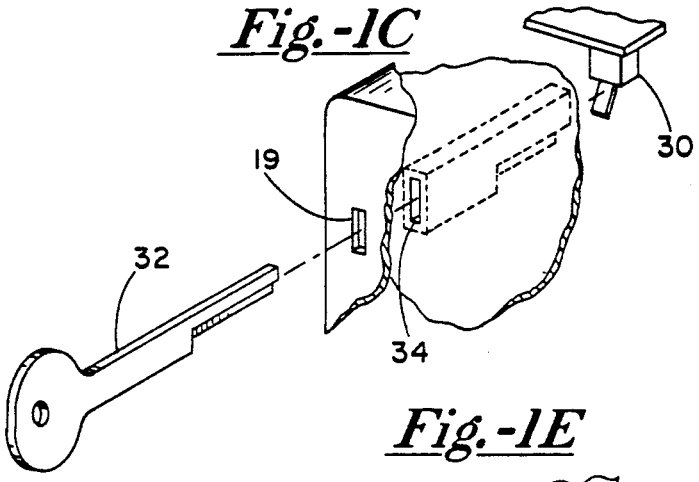
FIG. 1C is a detail view of a key and its matching slot.
Figure 1E:
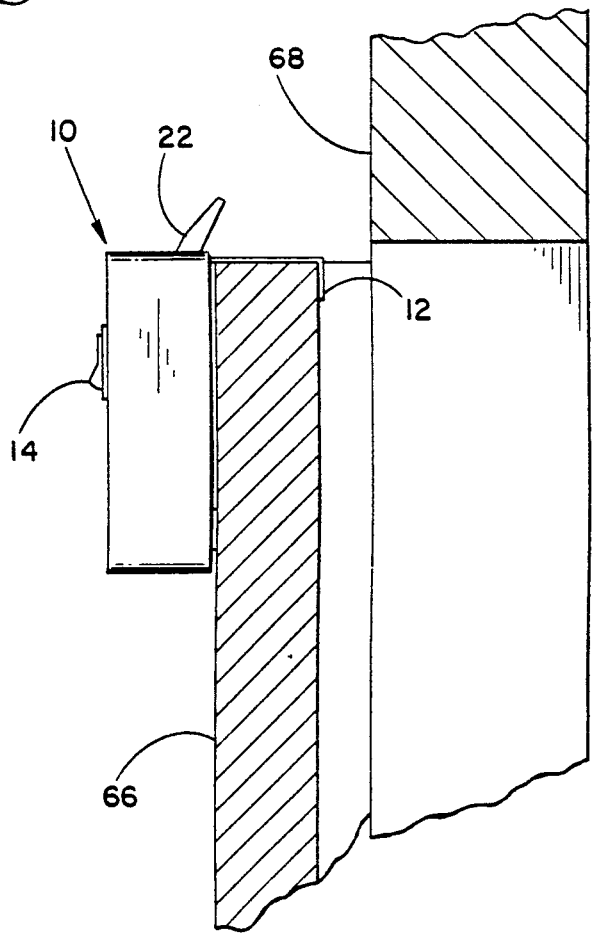
FIG. 1E is the view of FIG. 1D with the door ajar such that the door is moved away from its frame and the trip switch closed.

As shown in FIG 1C, key 32 is an alternative to card 16 and matches slot 34. Here the end of key 32 is narrower to match an offset in the bottom of slot 34 in order for the key to be inserted full length into the slot in order to trip reset switch 30.

Figure 2A:
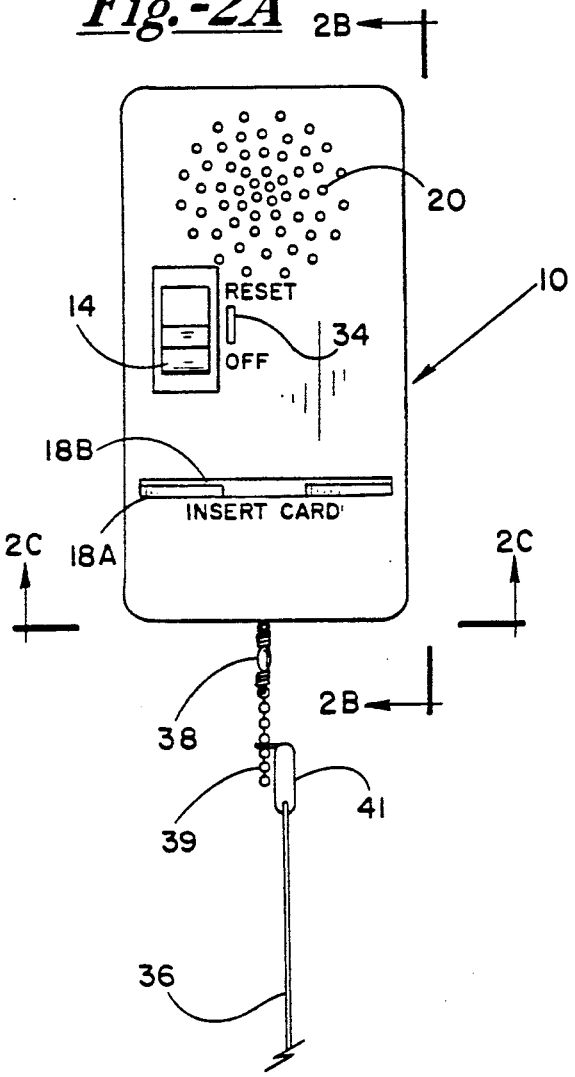
FIG. 2A is the front view of the second version of the first embodiment.
Figure 2B:
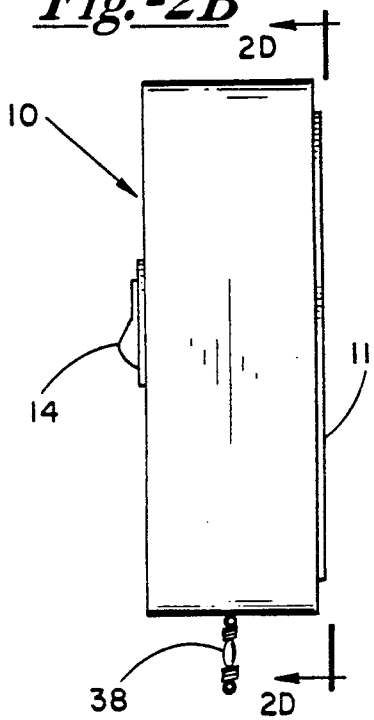
FIG. 2B is the side view of the version of FIG. 2A.
Figure 2C:
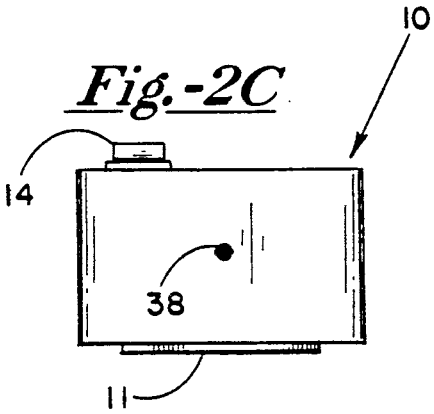
FIG. 2C is the bottom view of the version of FIG. 2A.

In FIG. 2A alarm box 10 has the same circuitry as in FIGS 1A, 1B, and 1C, however the trip switch here is a rotary switch which will be described in detail later. This rotary switch is rotated by a line attached to swivel 38, ball chain 39, and connector 41 to external line 36. Connector 41 can be attached to different portions of chain 39 to change the line length and position the switch in an open position. FIGS. 2B and 2C show the relationship of swivel 3B to box 10.

Figure 2D:
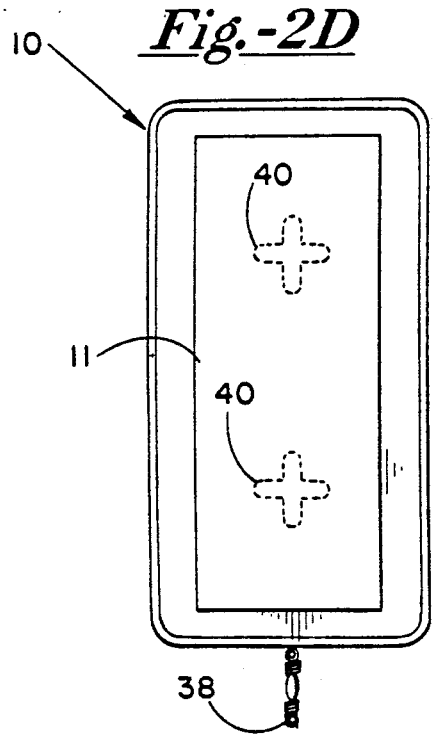
FIG. 2D is the back view of the version of FIG. 2A.

In FIG. 2D a strip 11 is shown attached to the rear of alarm box 10. Strip 11, either adhesive or magnetic, or slots 40 can be used to engage the heads of screws or bolts to attached box 10 to a mounting surface.

Figure 3A:
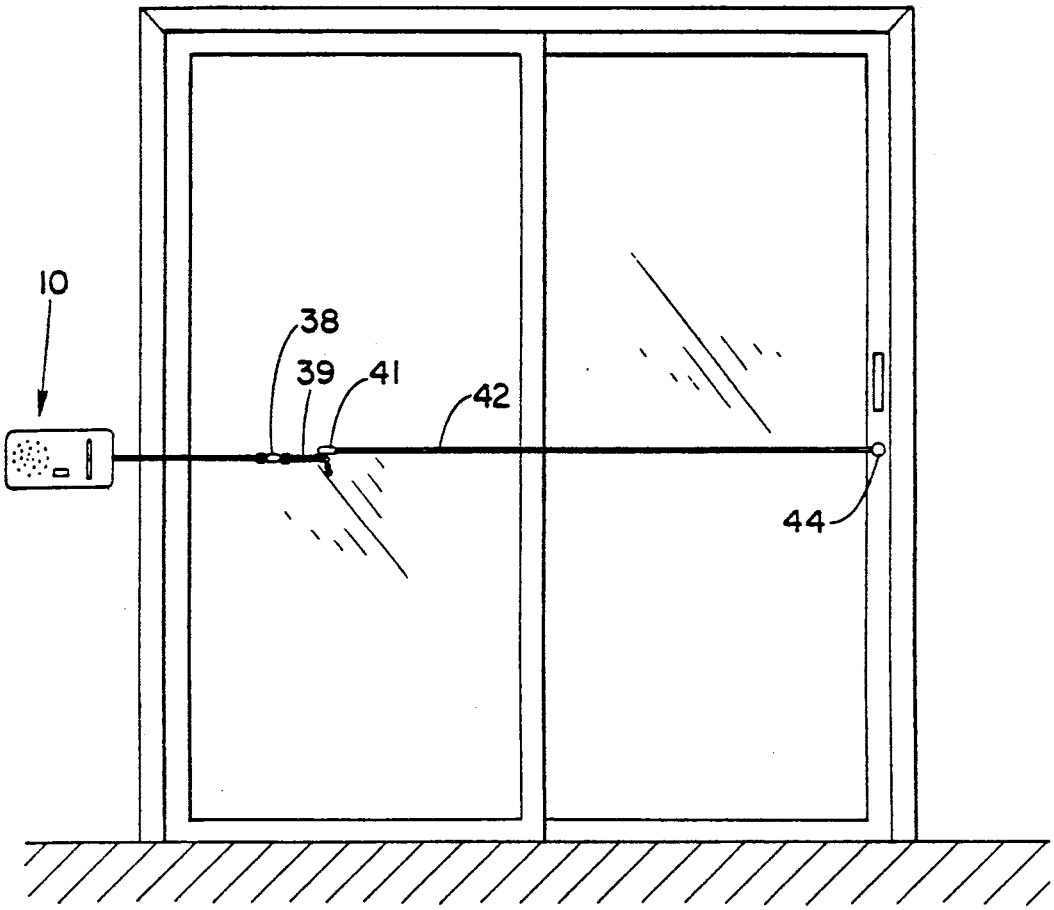
FIG. 3A is a front view of the second version of the first embodiment shown mounted adjacent to a sliding door.
Figure 3B:
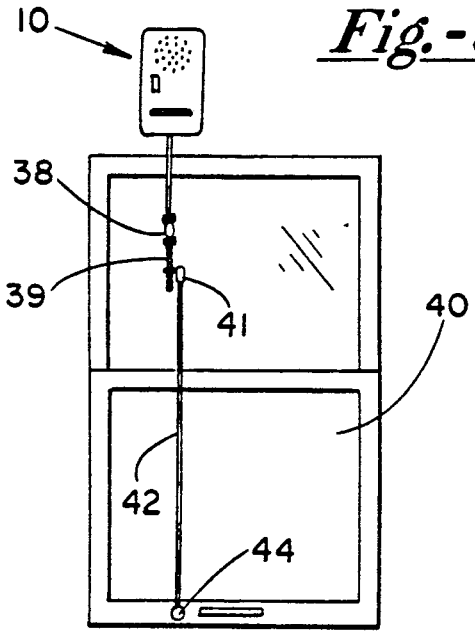
FIG. 3B is the version of FIG. 3A shown mounted above a window.

In FIG. 3A alarm box 10 is shown mounted adjacent a sliding door with extension line 42 attached to the door by a fastener cup 44, and the line length adjusted to open switch 22 so any movement of the line trips the alarm. In FIG. 3B alarm 10 is mounted above a window 40 with extension line 42 attached to the lower window so any intrusion or window movement will trip the alarm.

Figure 4A:
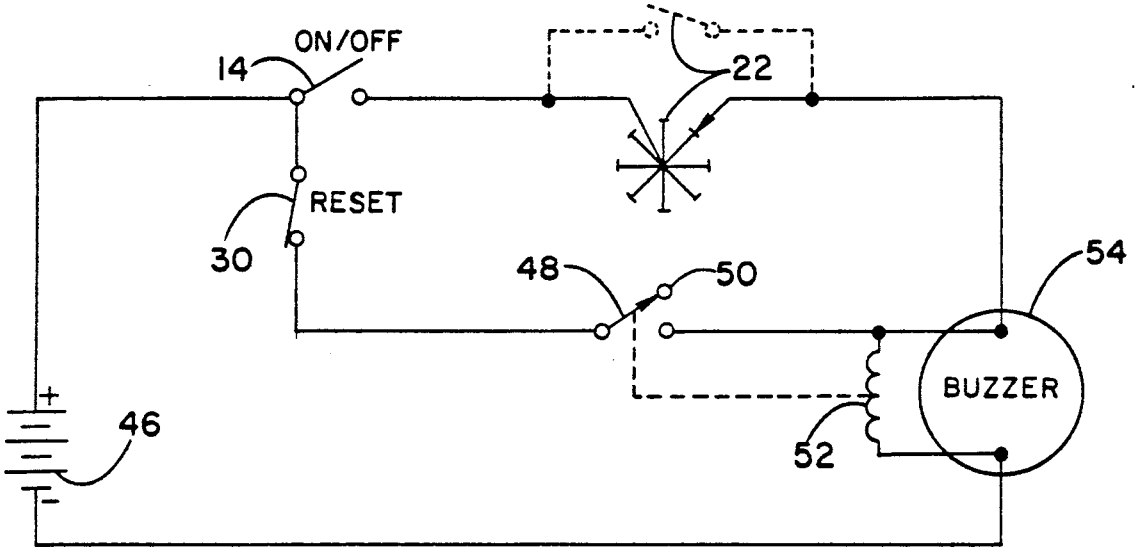
FIG. 4A is the circuit diagram of the first embodiment, with the single pole trip switch of the first version shown in dashed lines, and the rotary trip switch of the second version shown in solid lines.

In FIG. 4A the basic circuit is shown. This circuit has an on-off switch 14. A trip switch 22 which is either a rotary switch, shown in solid outline, or a spring loaded single pole switch, shown in dashed outline. A battery 46, relay 48, with normally open contacts 50 and coil 52, and buzzer 54 complete the basic circuit elements.

Note that on-off switch 14 must be in the on position in order for trip switch 22 to initially energize buzzer 54. Once buzzer 54 and relay coil 52 have been energized however then normally open relay contacts 50 will be closed which provides a path from the positive side of battery 46 to buzzer 54 regardless of the state of on-off switch 14 or trip switch 22. This ensures that when on-off switch 14 is on and trip switch 22 has closed, even if only momentarily, buzzer 54 will sound until reset switch 30 is opened.

Figure 4B:
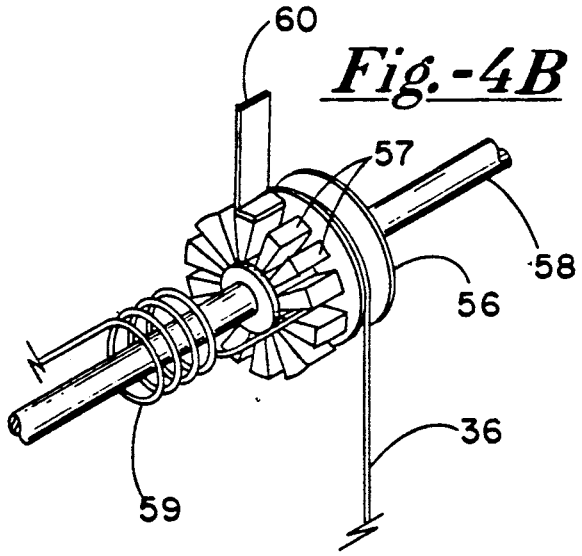
FIG. 4B is an isometric view of the rotary trip switch.

Trip switch 22 is shown in the rotary switch version in FIG. 4B. Cylinder 56 is made of insulating material such as plastic. A number of metal conducting segments 57 are evenly spaced around the periphery of cylinder 56 and extend inwardly to axle 58 which is made of conducting material. A coil spring 59 is wrapped around axle 58 with one end attached to cylinder 56 and the other end attached to alarm box 10. A wiper arm 60 is positioned adjacent to the circumference of cylinder 56 opposite conducting segments 57 such that it will contact the conducting segments as the cylinder is rotated. Line 36 has one end attached to cylinder 56 within a groove around the circumference of the cylinder adjacent to conducting segments 57. Line 36 is arranged such that as the free end of the line is pulled cylinder 56 will rotate and coil spring 59 will wind up. When there is no tension on line 36 wiper 60 will return to an initial position between conducting segments 57.

Figure 5A:
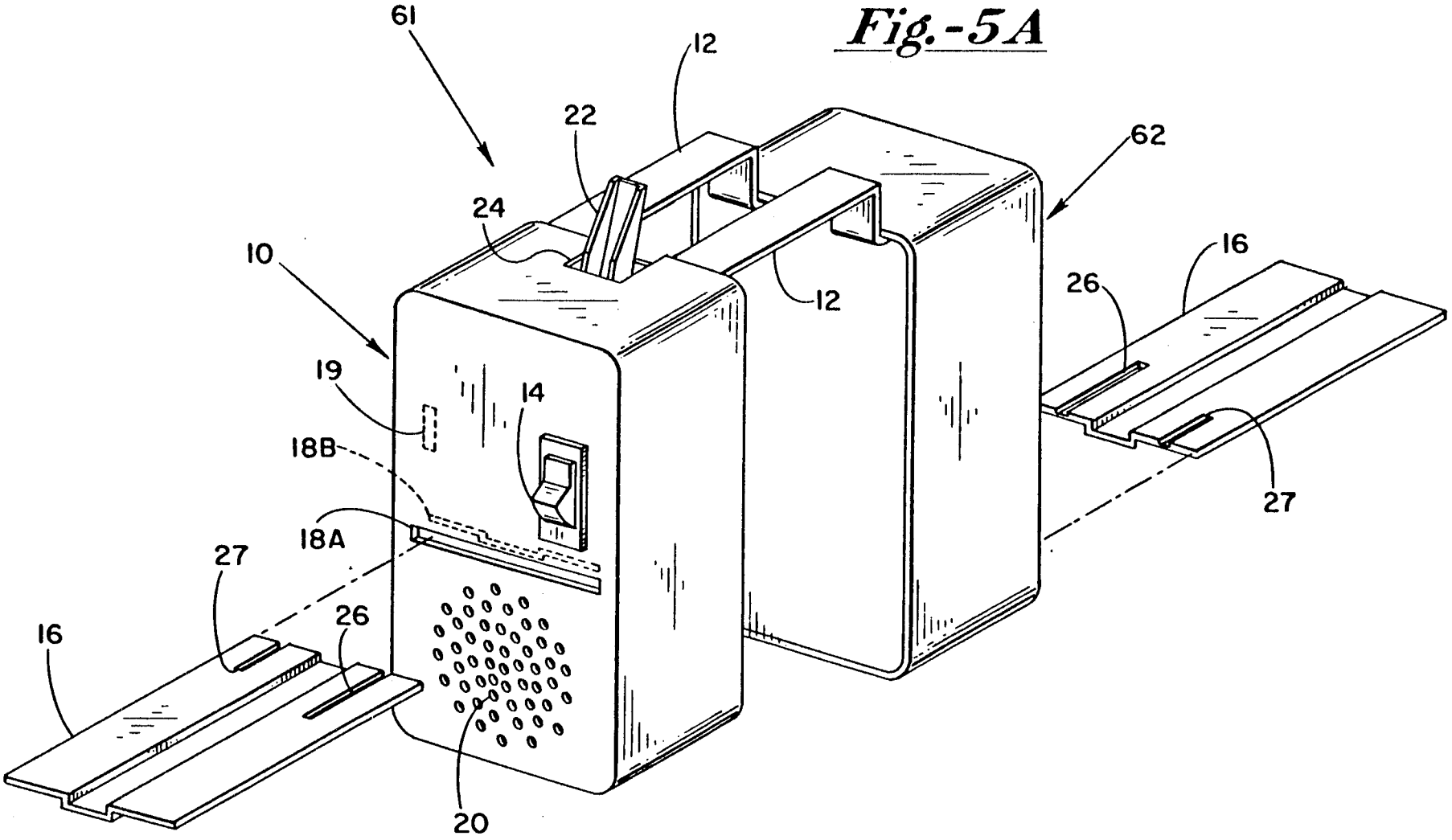
FIG. 5A is an isometric view of the second embodiment of the alarm.

In FIG. 5A a second embodiment 61 of the alarm is shown. This consists of an alarm box 10 which has the same circuitry and features as the first embodiment with some additions. The previous elements include brackets 12, on-off switch 14, a card 16, slots 18A and 18B, and 19, holes 20, switch 22 and hole 24. A second arm-disarm box 62 is provided which is similar physically to box 10. Box 62 also has a slot, not shown in this figure, for a card 16.

Figure 5B:
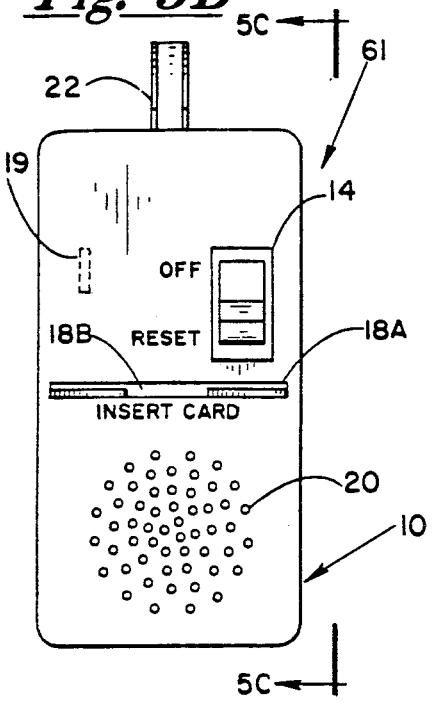
FIG. 5B is a front view of the alarm box of the second embodiment.
Figure 5C:
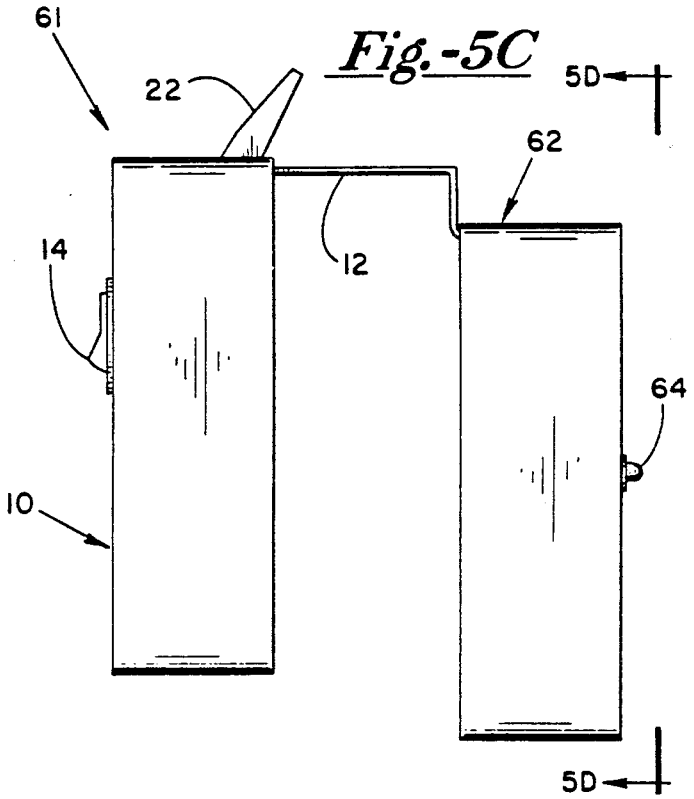
FIG. 5C is a side view of the second embodiment.

In FIG. 5B the front view of alarm box 10 is shown with these items. In FIG. 5C alarm box 10 connected to arm-disarm box 62 by bracket 12 can be seen.

Figure 5D:
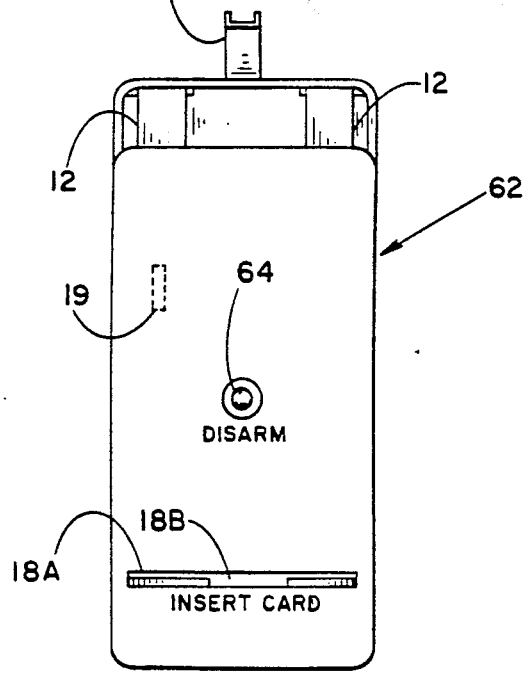
FIG. 5D is a front view of the arm-disarm box of the second embodiment.

In FIG. 5D the front face of arm-disarm box 62 can be seen. Here an outer rectangular shaped slot 18A and a rear slot 18B shaped to receive a card can be seen. In addition slot 19 shown in dashed outline can receive key 32. Slots 18A, 18B, and 19 can receive a card or key the same as those in alarm box 10. Here however an arm-disarm switch, not shown in this figure, is tripped in the same manner as reset switch 30 by the card 16 or key 32 whichever version is used. A light emitting diode 64 indicates the status of arm-disarm box 62 as will be explained with the circuit description.

Figure 5E:
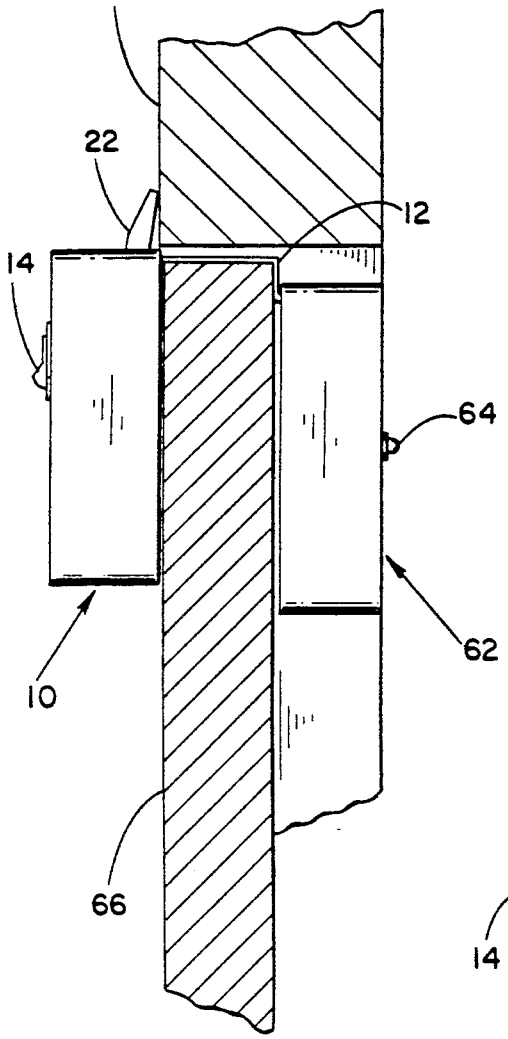
FIG. 5E is a side view of the second embodiment mounted over a door with the door closed into its frame, both being shown in cross-section.
Figure 5F:
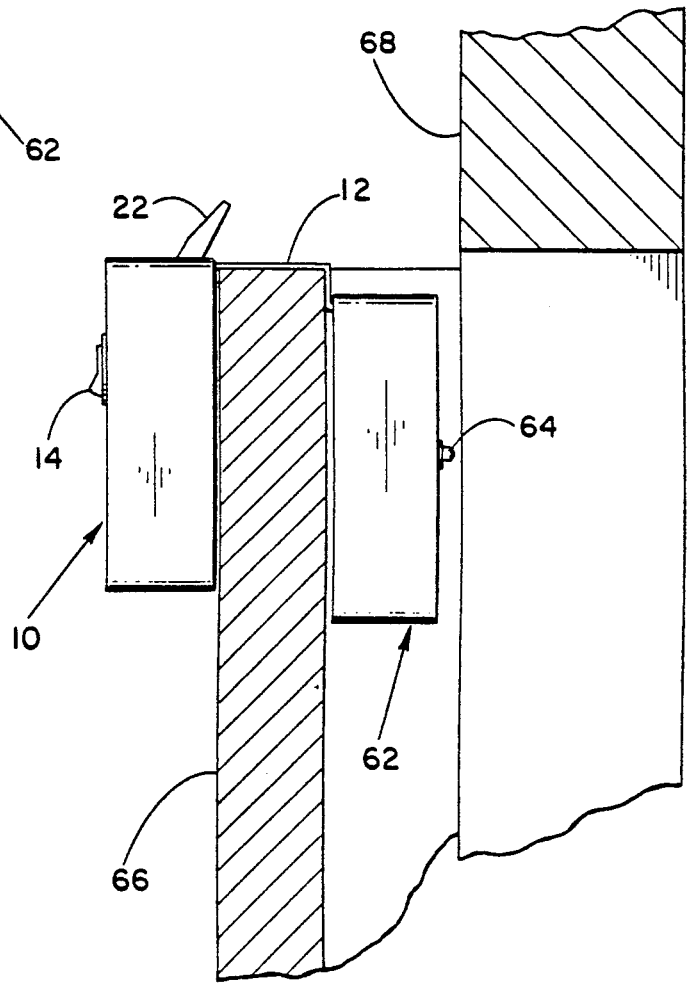
FIG. 5F is the version of FIG. 5E with the door ajar.

In FIG. 5E alarm box 10 and arm-disarm box 62 are shown on opposite sides of door 66 and held in place by bracket 12 attached to both boxes and shaped to extend over the door. Here door 66 is closed against door frame 68 which bears against the arm of switch 22 holding it open. In FIG. 5F door 66 is shown partially open with switch 22 carried away from frame 68 which permits switch 22 to close.

Figure 6:
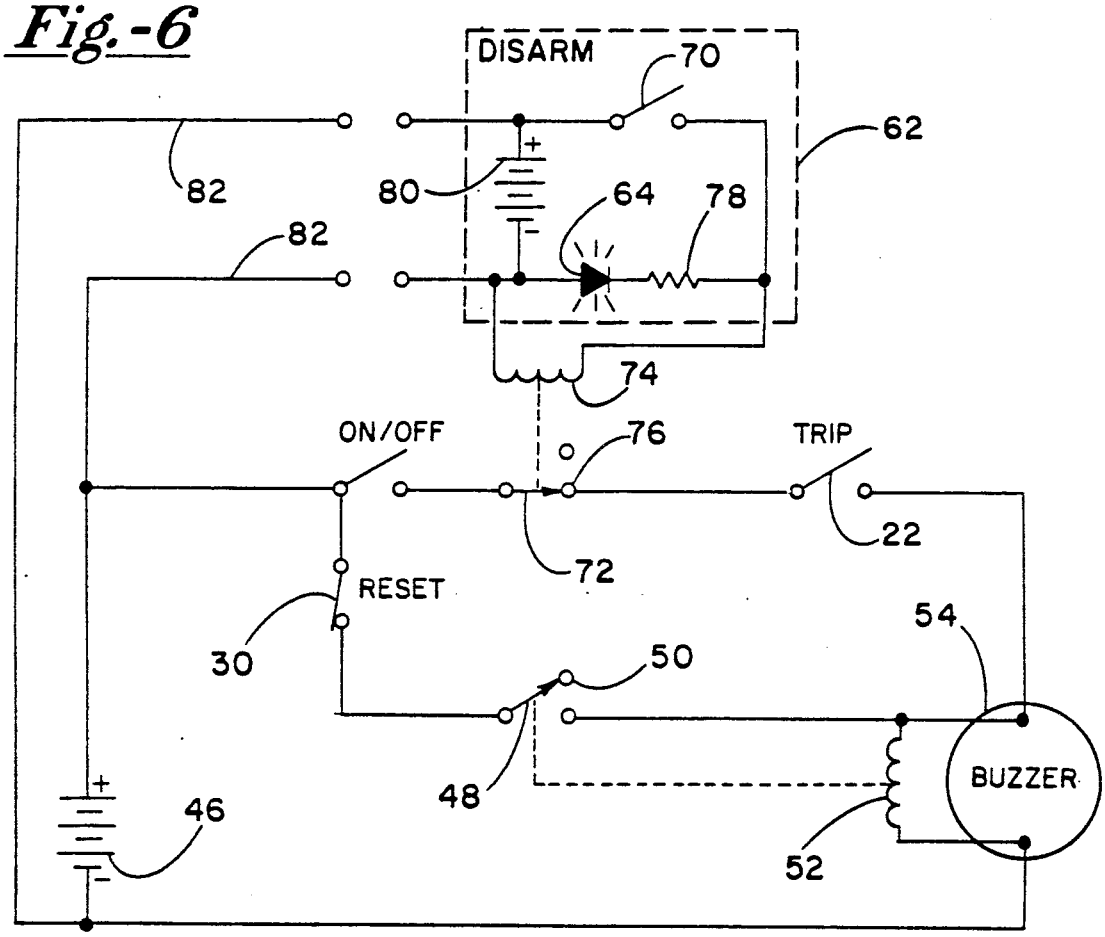
FIG. 6 is the circuit diagram of the second embodiment of the alarm with the components of the arm-disarm box being enclosed by a dashed outline.

In FIG. 6 the circuit diagram of the second embodiment is shown. This includes a number of items not used in the first embodiment. Arm-disarm switch 70 is closed by inserting either card 16 or key 32 into its respective matching slot. Relay 72, located in box 10, has a coil and normally closed contacts 76. Light emitting diode 64 is in series with resistor 78. Battery 80 can provide power for the arm-disarm functions or it can be omitted and power provided by battery 46 through wires 82 from alarm box 10. The dashed outline shows the circuit elements which are located within arm-disarm box 62. Brackets 12 are insulated and provide the connections to relay coil 74.

If battery 80 is omitted then an additional pair of wires 82 must be run from battery 46 in alarm box 10 to arm-disarm box 62 with the lines connected to each respective one of the points from battery 80 to provide the necessary power for this circuit. This alternative arrangement permits using one battery for both boxes.

The operation of the additional circuit elements of FIG. 6 provide a means of installing the alarm system over a door while turned on without the alarm sounding. In use a card 16 or key 32, is inserted into a mating slot in arm-disarm box 62 which will close switch 70 to energize the relay coil of relay 72 and open relay contacts 76. Light emitting diode 64 is also energized to show that this has occurred.

On-off switch 14 is then closed and since the system is not installed trip switch 22 is closed which would normally sound buzzer 54 but since relay contacts 76 are open this will not occur. The system is then installed over a door as shown in FIG. 5F. The user then exits the room and closes the door as shown in FIG 5E which opens trip switch 22. The user can then extract either card 16 or key 32, whichever was used, which will open arm-disarm switch 70 and permit relay contacts 76 to close and arm the system. If the door is reopened trip switch 22 will now cause buzzer 54 to sound the same as the first embodiment.

Before the user reenters the room arm-disarm switch 70 is closed by card 16 or key 32 which opens relay contacts 76 and again prevents the alarm from sounding. After the user has reentered the room on-off switch 14 can be used to turn off the system and card 16 or key 32 removed. The trip switch 22 which is used in this second embodiment is not the rotary type since a line is not used in this embodiment. The first version of the first embodiment using a spring loaded trip switch is intended primarily to be used with the alarm box mounted on a door adjacent to its top using the brackets, to cause the trip switch to close when the door is ajar.

The second version of the first embodiment using a rotary trip switch is intended primarily to be used with the alarm box mounted adjacent to a building opening with the line secured across the opening such that an intruder would either pull against or release the line to close the rotary trip switch.

The second embodiment provides a means of preventing the alarm from sounding even though the spring loaded trip switch is closed until the alarm is mounted with the brackets over the top of a door and the door closed.

Both embodiments provide either a key or card which must fit into a mating slot in order to reset the alarm after it has sounded.

This invention uses a simple holding circuit to keep the alarm sounding indefinitely until reset by a means not available to an intruder. The use of either a spring loaded trip switch or rotary switch to sound the alarm provides great flexibility in the manner of use.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. In self contained battery operated alarm apparatus of the type using audible alarm means and a trip switch which when closed will sound the alarm, arranged such that the alarm apparatus can be located and oriented on a door such as to close the trip switch when the door is ajar, the improvement comprising:

a) arm-disarm circuit means controlling an arm-disarm circuit arranged such that when said arm-disarm circuit means is energized said arm-disarm circuit is open and when said arm-disarm circuit means is deenergized said arm-disarm circuit is closed; and having first interconnecting circuitry connecting said arm-disarm circuit to said alarm apparatus such that when said arm-disarm circuit is open the alarm is prevented from sounding;

b) an arm-disarm box containing said arm-disarm circuit means, having attachment means arranged to attach said arm-disarm box to a door on the side opposite the alarm apparatus; said arm-disarm box having a slot of a predetermined depth extending inwardly from a slot opening of a predetermined size and shape in the surface thereof;

c) battery means and an arm-disarm switch having a spring loaded switch arm extending therefrom with a normally open first position and a closed second position, said battery means and said arm-disarm switch being connected such as to energize said arm-disarm circuit means whenever said arm-disarm switch is closed, and having an insert with a first and second dimension with a size and shape such that said first and second dimensions will mate with and fit within the slot opening, and with a third dimension greater than said slot depth such that said insert can be inserted into said slot to the bottom thereof with a predetermined amount of said insert extending outwardly therefrom; said arm-disarm switch being located and oriented within said arm-disarm box relative to said slot such that when said insert is inserted to the bottom of said slot, said arm of said arm-disarm switch will be forced by said insert from the first to the second position.

2. Apparatus as in claim 1 and further comprising:

a) said slot opening having a major and a minor dimension, and having at least one pin mounted within said slot at a predetermined depth, oriented generally perpendicular to the major slot dimension and extending across the minor slot dimension;

b) said insert having a first major and a second minor dimension corresponding to said slot opening, and said insert having a slit corresponding to each pin extending through the minor dimension thereof; said slits all beginning at a first end of said insert having a minor dimension and extending inward therefrom parallel to the major dimension thereof; said slits being dimensioned and located such that with said insert placed into said slot to the bottom thereof with said first end inward, each said pin will be bracketed by a respective opposed slit.

3. Apparatus as in claim 2 and further comprising:

a) said slot having at least two pins with each said pin having a different location with respect to the first dimension of said slot, and a different location with respect to the slot depth, said slits having lengths corresponding to the distance of said pin positions from the bottom of said slot, arranged such that with said insert placed within said slot with the first end inward to the bottom of said slot, each said pin will be bracketed by a respective opposed slit and be adjacent to the bottom thereof.

4. Apparatus as in claim 1 and further comprising:

a) said slot having an opening major and a minor dimension, said major dimension having at least one reduction in size from the opening of said slot to the bottom thereof, and with said insert having reductions in size across a corresponding major dimension, which reductions in size shall correspond to said slot reduction in size and locations and mate with said slot, such that said insert can be inserted with the narrowest minor dimension first into said slot to the bottom thereof.

5. Apparatus as in claim 1 with the alarm apparatus having battery means providing said battery means for the arm-disarm circuitry, said battery means having second interconnecting means connecting said battery means to said arm-disarm switch and said arm-disarm circuit means.

6. Apparatus as in claim 1 with said alarm apparatus having an alarm box and being contained therewithin, and having brackets which are arranged to extend over the top of said door such as to attach said alarm box to said arm-disarm box and to support each said box and to provide said arm-disarm box attachment means.

7. Apparatus as in claim 1 further comprising a light emitting diode and resistor, said diode and resistor being connected in series across said arm-disarm circuit means such as to provide an indication when said arm-disarm circuit means is energized.

8. Apparatus as in claim 1 wherein said arm-disarm circuit means comprises a relay having a coil, and wherein said arm-disarm circuit comprises a set of contacts of said relay, said contacts being open when said coil is energized and closed when said coil is deenergized.

9. Apparatus as in claim 6, wherein said brackets are made of conductive material and insulated from said alarm box and said arm-disarm box, and arranged such as to provide said first interconnecting circuitry.

10. In self contained battery operated alarm apparatus of the type using audible alarm means and a trip switch which when closed will sound the alarm, arranged such that the alarm apparatus can be located and oriented on a door such as to close the tip switch when the door is ajar, said alarm apparatus having holding circuit means for controlling a holding circuit, said holding circuit means comprised of a relay having a coil, and wherein said holding circuit comprises a set of contacts of said relay, said contacts being closed when said coil is energized and open when said coil is deenergized, said relay being connected to said alarm apparatus such as to be energized whenever the alarm is sounded, said set of contacts of said relay being connected to the alarm apparatus such as to sound said alarm whenever said set of relay contacts are closed, the improvement comprising:

a) an alarm box arranged to contain the alarm apparatus, said alarm box having a slot of a predetermined depth extending inwardly from a slot opening of a predetermined size and shape in the surface thereof;

b) a reset switch having a spring loaded switch arm extending therefrom with a normally closed first position and an open second position, said reset switch being connected in series with and opening said holding circuit whenever said reset switch is open and completing said holding circuit whenever said reset switch is closed;

c) an insert with a first and second dimension of a size and shape such that said first and second dimensions will mate with and fit within said slot opening, and with a third dimension greater than said slot depth such that said insert can be inserted into said slot to the bottom thereof with a predetermined amount of said insert extending outwardly therefrom; said reset switch being located and oriented within said alarm box relative to said slot such that when said insert is inserted to the bottom of said slot, said arm of said reset switch will be forced by said insert from the first to the second position.

11. Apparatus as in claim 10 and further comprising:

a) said slot opening having a major and a minor dimension, and having at least one pin mounted within said slot at a predetermined depth, oriented generally perpendicular to the major slot dimension, and extending across the minor slot dimension;

b) said insert having a first major and a second major dimension corresponding to said slot opening, said insert having a slit corresponding to each pin extending through the minor dimension thereof; said slits all beginning at a first end of said insert having a minor dimension and extending inward therefrom parallel to the major dimension thereof; said slits being dimensioned and located such that with said insert placed into said slot to the bottom thereof with said first end inward, each said pin will be bracketed by a respective opposed slit.

12. Apparatus as in claim 11 and further comprising:

a) said slot having at least two pins with each said pin having a different location with respect to the first dimension of said slot, and a different location with respect to the slot depth, said slits having lengths corresponding to the distance of said pin positions from the bottom of said slot, arranged such that with said insert placed within said slot with the first end inward and to the bottom of said slot, each said pin will be bracketed by a respective opposed slit and be adjacent to the bottom thereof.

13. Apparatus as in claim 10 and further comprising:

a) said slot having an opening with a major and a minor dimension, said major dimension having at least one reduction in size from the opening of said slot to the bottom thereof, and with said insert having reductions in size across a corresponding major dimension, which reductions in size shall correspond to said slot reduction in size and locations and mate with said slot, such that said insert can be inserted with the narrowest major dimension first into said slot to the bottom thereof.

14. In self contained battery operated alarm apparatus of the type using audible alarm means arranged to be placed within a building near an outer opening thereof, having a switch with a switch trip comprising an attached line for closing said switch, and being connected to said alarm apparatus such as to sound the alarm when said switch is closed, said line being arranged such that whenever said line is disturbed said line will close said switch, the improvement comprising:

a) said switch comprising a rotary switch having a rotor with spring return means for returning said rotor to an initial open position, said rotary switch having means for completing a number of switch closures for each rotor rotation, having rotation means for rotating said rotor by means of said line, and having said line connected thereto, said line being arranged to extend from said rotary switch across a building opening when the alarm apparatus is attached near the building opening with a predetermined orientation, such that when said line is disturbed said rotor will be rotated by said line and cause a closure of said switch.

15. Apparatus as in claim 14 and further comprising:

a) line attachment means for attaching the free end of said line to-a generally flat surface;

b) line length adjustment means for changing the length of an attached line.

16. Apparatus as in claim 15 wherein said line attachment means is a fastening cup.

17. Apparatus as in claim 14 wherein said line length adjustment means comprises a ball chain and ball chain attachment means for attaching the chain, said ball chain attachment means having an opening on one end sized to receive a line and a bifurcated bracket on the opposite end, said bracket being arranged and sized to grip the opening between balls of said ball chain when inserted therebetween.

* * * * *